United States Patent [19]

Urabe

[11] 4,399,435

[45] Aug. 16, 1983

[54] MEMORY CONTROL UNIT IN A DISPLAY APPARATUS HAVING A BUFFER MEMORY

[75] Inventor: Kiichiro Urabe, Hadano, Japan

[73] Assignee: Hitachi, Ltd., Tokyo, Japan

[21] Appl. No.: 232,003

[22] Filed: Feb. 6, 1981

[30] Foreign Application Priority Data

Feb. 8, 1980 [JP] Japan ..... 55-13726

[51] Int. Cl.[3] ..... G09G 1/16

[52] U.S. Cl. ..... 340/750; 340/802; 340/801

[58] Field of Search ..... 340/723, 721, 744, 748, 340/749, 750, 745, 798, 801, 802

[56] References Cited

U.S. PATENT DOCUMENTS 3,345,458 10/1967 Cole et al. ..... 340/750

3,426,344 2/1969 Clark ..... 340/750

3,849,773 11/1974 Katahira et al. ..... 340/745

*Primary Examiner*—Marshall M. Curtis

*Attorney, Agent, or Firm*—Antonelli, Terry & Wands

[57] ABSTRACT

A digital data display apparatus in which digital data to be displayed are stored in a refresh memory and displayed on a CRT display screen while scanning with rasters. The apparatus comprises a first buffer memory and a second buffer memory so that data read out from the refresh memory can be stored in the mode classified by an odd row and an even row respectively. When the display data stored in the first or second buffer memory are being displayed in an odd or even row on the display screen, the horizontal flyback period of that row is utilized so as to read out display data for the other row from the refresh memory, and store the same in the second or first buffer memory. In this manner, display data are alternately stored in and read out from the first and second buffer memories so that all the data can be displayed over the entire area of the display screen.

14 Claims, 4 Drawing Figures

MEMORY CONTROL UNIT IN A DISPLAY APPARATUS HAVING A BUFFER MEMORY

BACKGROUND OF THE INVENTION

This invention relates to a memory control unit in a display apparatus of the raster scan type, and more particularly to a control system for controlling a refresh memory which stores data to be displayed on a CRT (cathode-ray tube) of the TV scan type.

In the art of digital data display, a refresh memory is generally combined with a CRT for displaying, for example, digitized characters on the display screen of the CRT. Such digital data to be displayed is stored in the refresh memory and is successively read out from the refresh memory in synchronism with the raster scanning of the display screen of the CRT. On the basis of the digital data read out from the refresh memory, a character generator generates character patterns which are entrained on the scanning beam to be displayed on the display screen of the CRT.

Two methods as described below are commonly known and put into practice for the control of the reading out of data stored in such a refresh memory to be displayed on the display screen of a CRT.

In one of these two prior art methods, the refresh memory, from which data to be displayed is read out, functions completely as a read-only memory during the period of character display on the display screen of the CRT. According to this first method, a request for access to the refresh memory from the logic circuit controlling the CRT is not accepted until the end of the refresh time, since the refresh memory is completely occupied for refreshing the display on the display screen of the CRT during the display period. This results inevitably in an extreme reduction of the processing performance of the system during this period. A steal of the refresh cycle during the display period in an attempt to improve the processing performance will result in an improper display during that cycle, tending to provide a flickering display.

The second method is disclosed in, for example, U.S. Pat. No. 3,701,988. In accordance with this U.S. patent, one row portion of data to be displayed is read out from the refresh memory to be stored in a buffer memory during the period of an inter-row space in which no characters are displayed, so that such data can then be read out from the buffer memory to be displayed on the display screen of a CRT. The technical idea of this patent is advantageous in that the provision of the buffer memory storing one row portion of data can shorten the period of time during which the refresh memory is occupied for the reading purpose, so that the processing performance of the system can be improved. The second method is further advantageous in that the refresh memory need not be operated at a high speed since the data can be read out from the refresh memory during the period of an inter-row space. However, this second method is not applicable to a system which is designed to additionally display, for example, graphic characters and/or rulings which extend across or appear in the inter-row space as well. Although a system using a CRT of the full raster scan type to exhibit an additional function of displaying rulings or the like in the inter-row space is widely employed at present, the technical idea of the second method is not applicable to such a system, since data to be displayed is read out from the refresh memory during the period of the inter-row space and no display is provided during this period according to the principle of the second method.

SUMMARY OF THE INVENTION

It is therefore an object of the present invention to provide a novel and improved memory control unit for a display apparatus of the raster scan type in which the refresh memory is not completely occupied for the refreshing of a display on the display screen of a CRT and which minimizes the possibility of declining a request for other access to the refresh memory thereby greatly improving the processing performance of the system.

Another object of the present invention is to provide a memory control unit for a display apparatus of the raster scan type which is capable of displaying, for example, graphic characters and/or rulings in the inter-row space too.

Another object of the present invention is to provide a memory control unit for a display device in which character codes to be displayed are read out of the memory during a horizontal retrace period and the memory may be accessible during a display period for other objects than displaying.

The present invention contemplates the provision of a memory control unit for a display apparatus of the raster scan type in which digital data to be displayed is stored in a refresh memory and converted by a character generator into patterns which are displayed on a display screen while scanning with rasters, the apparatus comprising, as buffer means for storing data read out from the refresh memory, a buffer memory capable of storing at least two row portions of data displayed on the display screen so that, during the display period of a row on the display screen, display data for that row can be read out from the buffer memory to be displayed on the display screen, while during the horizontal flyback period of that row, display data for the succeeding row can be read out from the refresh memory to be written in the buffer memory. More precisely, the buffer memory is composed of an odd-row buffer memory and an even-row buffer memory. When digital data is to be displayed in an odd row on the CRT display screen, such data is read out from the odd-row buffer memory, and the character generator generates corresponding character patterns which are entrained on the scanning line to be displayed on the CRT display screen. Generally, each of the rows is displayed by a plurality of scanning lines. While the data is being displayed in the odd row on the CRT display screen, the horizontal flyback periods of the scanning lines are utilized so as to sequentially read out the data of the succeeding row or even row from the refresh memory and store the same in the even-row buffer memory to prepare for the display of the latter data on the CRT display screen. Then, when the digital data of the even row is to be displayed on the CRT display screen upon completion of the display of the odd row, such data is read out from the even-row buffer memory so as to similarly display the corresponding character patterns in the even row on the CRT display screen. The horizontal flyback periods of the scanning lines displaying the even row are also utilized so as to read out digital data of the succeeding row or odd row from the refresh memory and store the same in the odd-row buffer memory. Such an operation is repeatedly carried out over the entire area of the CRT display screen to display all the character patterns on the CRT display.

The present invention having the aforementioned features is advantageous in that the refresh memory is not completely occupied for the refreshing of a display on the CRT display screen and the possibility of declining a request for the other access to the refresh memory can also be minimized. Due especially to the fact that a portion of the horizontal flyback period is utilized for reading out data from the refresh memory, block transfer of data from the system bus can be carried out at a high speed thereby greatly improving the performance of the display apparatus. Further, due to the fact that the period required for reading out data from the refresh memory can be determined to match the access time of the memory element, a low-speed memory element can be employed for constituting the refresh memory thereby considerably reducing the cost of the display apparatus. In the present invention, data to be displayed is read out from the refresh memory and stored in the buffer memory utilizing the horizontal flyback periods of the scanning lines. Therefore, when inter-row data such as graphic pattern data and/or ruling pattern data is additionally stored in the refresh memory and similarly read out therefrom to be stored in the buffer memory, the graphic patterns and/or the ruling patterns can also be displayed on the CRT display.

DESCRIPTION OF THE PREFERRED EMBODIMENT

Figure 1:
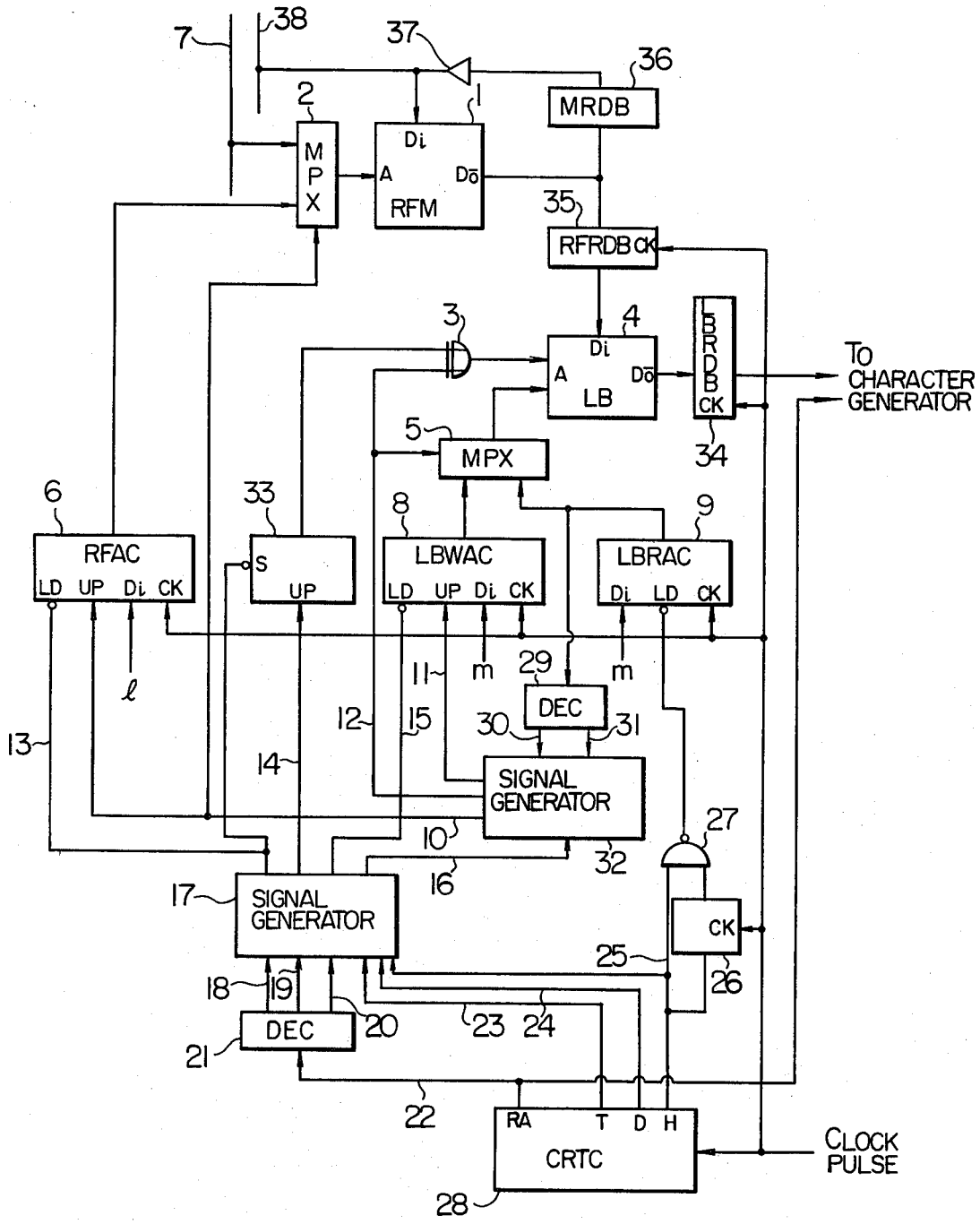
FIG. 1 is a block diagram of an embodiment of the digital data display apparatus of the present invention showing application of the present invention to a CRT display apparatus.

FIG. 1 is a block diagram of an embodiment of the memory control unit for a display apparatus according to the present invention when the present invention is applied to a CRT display apparatus for controlling a refresh memory in the apparatus.

The apparatus embodying the present invention is adapted to display 80 characters in each of 24 vertically spaced rows on the display screen of a CRT (not shown), with each of the characters being displayed in the form of a character pattern composed of 7 horizontal dots and 9 vertical dots. In the embodiment of the present invention, each of the 24 rows is scanned with 16 rasters ranging from a raster No. 0 to a raster No. 15, and each of the characters in each row is displayed in the range between the raster No. 1 and the raster No. 9. Therefore, the inter-row space is provided by the raster No. 10 to the raster No. 15 and the raster No. 0 in the next row.

Referring now to FIG. 1 of the drawings, character clock pulses are applied to clock terminals CK of a CRT controller (CRTC) 28, a flip-flop 26, an address counter (RFAC) 6 for a refresh memory (RFM) 1, a write address counter (LBWAC) 8 for a buffer memory (LB) 4, a read address counter (LBRAC) 9 for the buffer memory 4, a read register (LBRDA) 34 for the buffer memory 4 and a read register (RFRDB) 35 for the refresh memory 1.

The CRT controller 28 is a programable one and generates control signals for controlling various circuit portions of the CRT. More precisely, a raster address signal 22, a vertical synchronizing signal 23, a display period signal 24 and a horizontal synchronizing signal 25 are generated from the CRT controller 28. Further, the CRT controller 28 includes a programable horizontal counter which counts the horizontal position of characters. The output from this horizontal counter provides the horizontal synchronizing signal 25.

Figure 4:
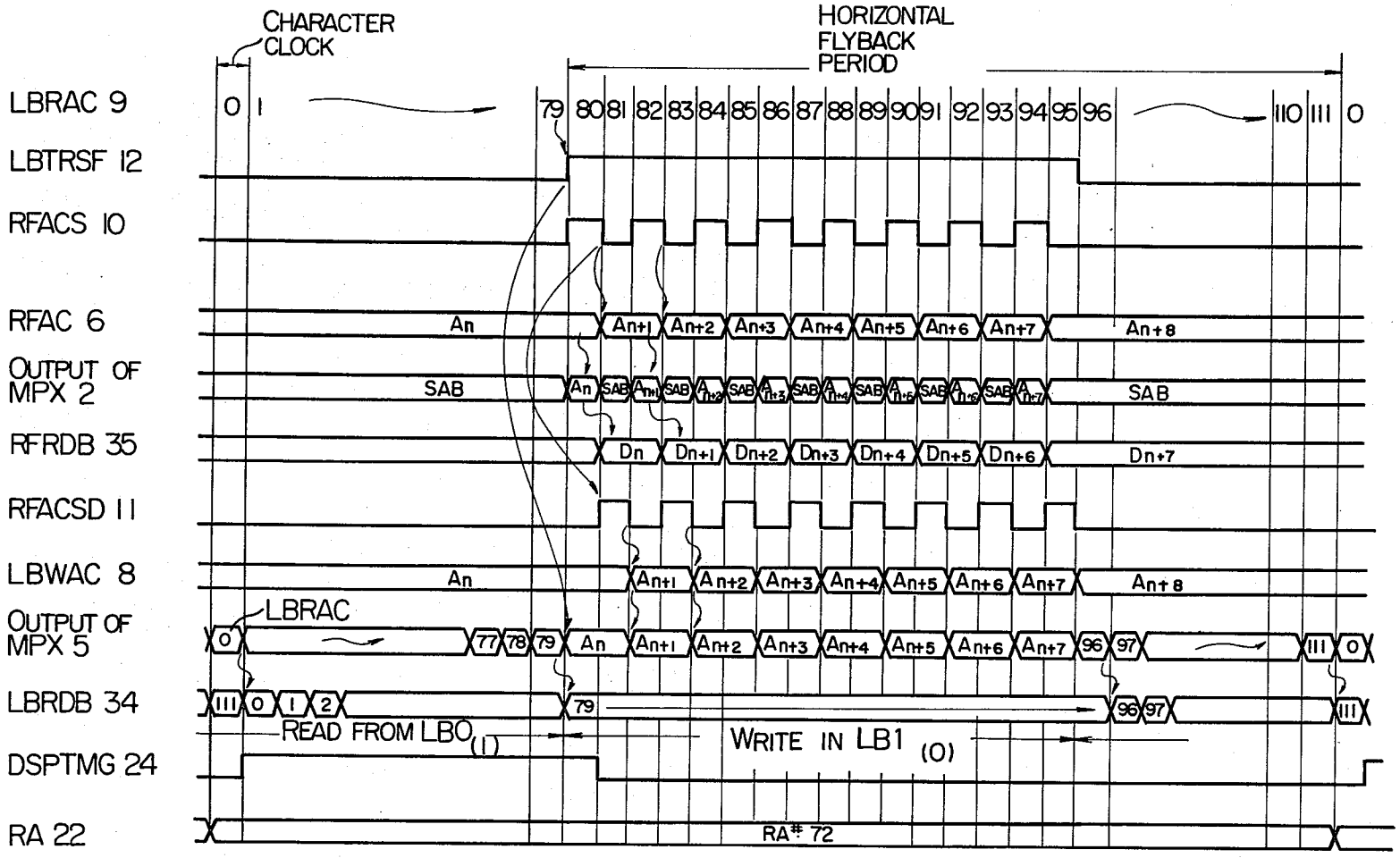
FIG. 4 is a timing chart of the portion (A) in FIG. 3 to illustrate in further detail the operation of the apparatus according to the present invention.

Among the output signals of the CRT controller 28, the value of the raster address signal 22 is sequentially renewed from "0" to "15" as shown by RA22 in FIG. 4. This raster address signal 22 is applied to a decoder 21 and to a character generator (not shown). The display period signal 24 indicative of the display period is shown by DSPTMG24 in FIG. 4. The vertical synchronizing signal 23 and the display period signal 24 are applied to a signal generator circuit 17. The horizontal synchronizing signal 25 is applied directly to the signal generator circuit 17 and is also applied to a NAND gate 27 directly and through the flip-flop 26.

The decoder 21 decodes the raster address signal 22. The decoder 21 generates a raster signal 18 when the value of the signal 22 is "0" (RST#0), a raster signal 19 when the value of the signal 22 is "1" to "10" (RST#1 to RST#10), and a raster signal 20 when the value of the signal 22 is "15" (RST#15). These raster signals 18, 19 and 20 are applied to the signal generator circuit 17.

In the signal generator circuit 17, the logical AND result of the raster signal 18 and the vertical synchronizing signal 23 is gated by the horizontal synchronizing signal 25, and the resultant signal provides a refresh memory address load signal 13. This refresh memory address load signal 13 is applied to a load terminal of the refresh memory address counter 6 and also to a set terminal of a row counter 33. The logical AND result of the display period signal 24 and the vertical synchronizing signal 23 is gated by the raster signal 18, and the resultant signal provides a buffer write address load signal 15 which is applied to a load terminal of the write address counter 8 for the buffer memory 4. Further, the logical product of the display period signal 24 and the raster signal 20 is gated by the horizontal synchronizing signal 25, and the resultant signal provides a row count signal 14 which is applied to a count-up terminal of the row counter 33. A buffer transfer command signal 16 appears from the signal generator circuit 17 in response to the application of the raster signal 19 which is generated from the decoder 21 when the raster address signal 22 represents RST#1 to RST#10.

The output from the NAND gate 27 is applied to a load terminal of the read address counter 9 as a horizontal direction synchronizing signal. As described hereinbefore, this read address counter 9 is associated with the buffer memory 4 described later. This address counter 9 counts repeatedly the train of character clocks No. 0 to No. 111 for each raster as shown by LBRAC9 in FIG. 4, that is, the counter 9 has the capacity of counting 112 characters in the horizontal direction. In response to the application of the synchronizing signal from the NAND gate 27 to its load terminal and a read address n to its data terminal, the address counter 9 starts to count the addresses of characters from this address n.

The output from this address counter 9 is applied to an address switching unit (MPX) 5 and to another decoder 29. This latter decoder 29 decodes the address of a 79th character (CH#79) and that of a 95th character (CH#95) applied from the address counter 9 and applies a character signal 30 indicative of the former and a character signal 31 indicative of the latter to another signal generator circuit 32. More precisely, the address of the character CH#79 is decoded to indicate that 80 characters CH#0 to CH#79 are to be displayed in each row during the display period, and the address of the character #95 is decoded to indicate that display data is to be applied at a rate of 8 characters to the buffer memory 4 from the refresh memory 1 during the time, CH#80 to CH#95, within the horizontal flyback period of each raster.

On the basis of the character signal 30 obtained by decoding the address of the character #79, the character signal 31 obtained by decoding the address of the character #95 and the buffer transfer command signal 16, the signal generator circuit 32 generates a refresh memory access signal 10 (RFACS10), a buffer transfer signal 12 (LBTRSF12) and a refresh memory access delay signal 11 (RFACSD11) shown in FIG. 4. The refresh memory access signal 10 is used to read out unit character display data from the refresh memory 1 and is applied to a count-up terminal of the address counter 6 and to another address switching unit (MPX) 2. The buffer transfer signal 12 is used to transfer to the buffer memory 4 the display data read out from the refresh memory 1 and registered in the register 35. This signal 12 is applied to the address switching unit 5 and to an exclusive-OR gate 3. The refresh memory access delay signal 11 is a signal which is delayed relative to the refresh memory access signal 10 by a time corresponding to one character and is applied to a count-up terminal of the write address counter 8.

In response to the application of the refresh memory address load signal 13 to the load terminal of the address counter 6, a display start address l is loaded to a data input terminal of the address counter 6 so that display data can now be continuously read out from the refresh memory 1. Thereafter, the count of the address counter 6 increases each time the refresh memory access signal 10 is applied to its count-up terminal. This count of the address counter 6 is loaded on the display start address l each time one frame has been displayed on the CRT display screen. FIG. 4 shows by RFAC6 that the display start address l is An and the counter 6 counts eight during scanning with a raster.

The address switching unit 2 is in the form of a known multiplexer, and the output from the address counter 6 and address information transmitted via an address bus 7 are applied to this address switching unit 2. One of these two inputs is selected in response to the application of the refresh memory access signal 10 to the address switching unit 2. More precisely, when the refresh memory access signal 10 shown in FIG. 4 is in its "1" level, the output from the address counter 6 is applied through the address switching unit 2 to the refresh memory 1, so that the display data stored in the refresh memory 1 can be read out at a rate of 8 characters per raster scan. On the other hand, when the refresh memory access signal 10 turns into its "0" level from its "1" level, the output from the address counter 6 is not applied to the refresh memory 1. In this latter case, the address switching unit 2 permits application of address information from the address bus 7 so that display data can be written in the refresh memory 1 from a data bus 38. As described later, data to be displayed on the CRT display screen is sequentially read out from the buffer memory 4. Therefore, during the so-called display period in which the character clocks corresponding to CH#0 to CH#79 are applied, and also, during a portion of the horizontal flyback period in which the signal RFACS10 is in its "0" level, access from another circuit or unit to the refresh memory 1 is possible so that display data can be freely written in or read out from the refresh memory 1 during this period.

The refresh memory 1 stores a sufficient amount of display data to be displayed on the CRT display screen, and display data corresponding to 8 characters (words) per raster is read out from the refresh memory 1 to be registered in the register 35. On the other hand, display data read out from the refresh memory 1 in response to a request transmitted via the address bus 7 is registered in the register 36, and such display data is sent out to another logic unit via a bus driver 37 of on-state and via the data bus 38. The bus driver 37 is turned off when display data applied via the data bus 38 is to be written in the refresh memory 1.

Figure 3:
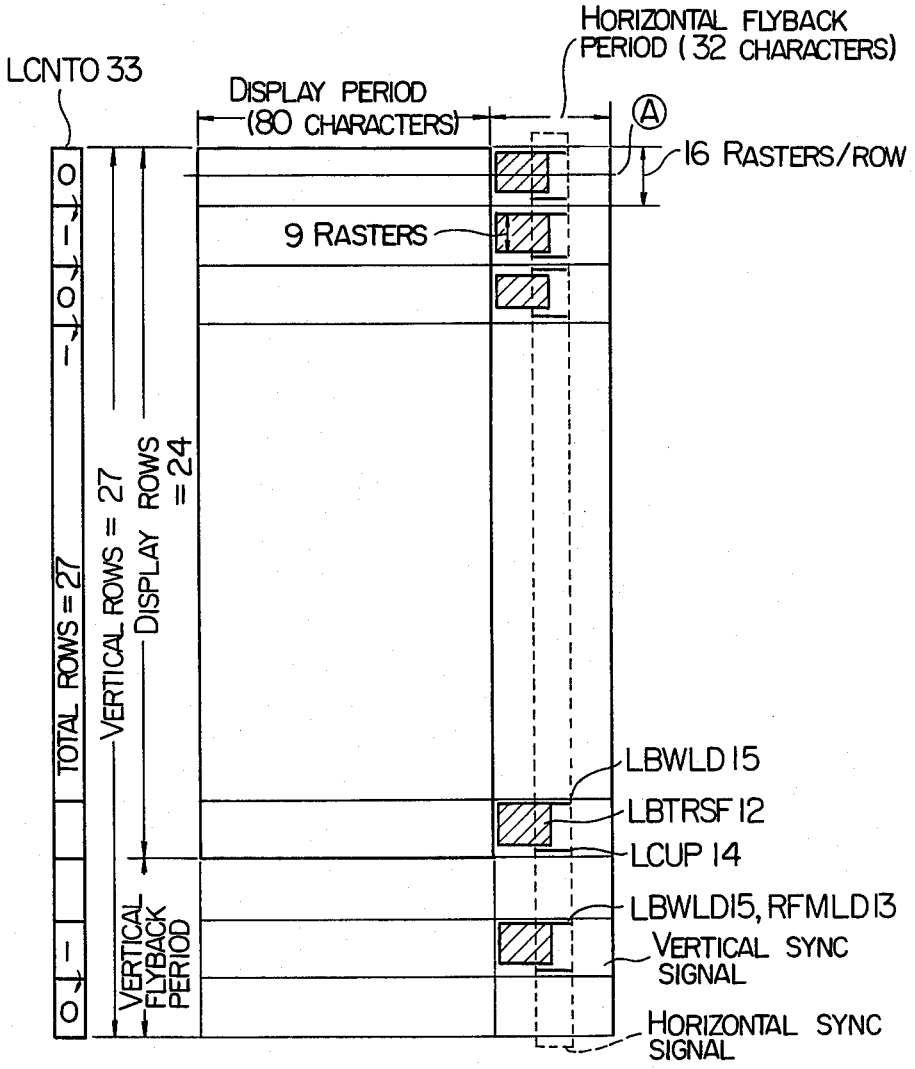
FIG. 3 is a schematic view of the display to illustrate the operation of the embodiment shown in FIG. 1.

The aforementioned row counter 33 is set in response to the application of the refresh memory address load signal 13 to its set terminal, and its count increases each time the row count signal 14 is applied to its count-up terminal. This row counter 33 is a binary counter. FIG. 3 shows, on the left-hand side thereof, the count LCNT0 of this row counter 33. It will be seen that "0" is registered in a stage corresponding to an odd row on the CRT display screen and "1" is registered in a stage corresponding to an even row on the CRT display screen. The output from this row counter 33 is applied to the exclusive-OR gate 3. The output from this exclusive-OR gate 3 represents the exclusive-OR of the output from the row counter 33 and the buffer transfer signal 12 from the signal generator circuit 32. Thus, this gate 3 selects an odd or even row during the display period in which 80 characters corresponding to CH#0 to CH#79 are displayed by the horizontal rasters and during a portion of the horizontal flyback periods corresponding to #80 to #95 in which display data is transferred from the refresh memory 1 to the buffer memory 4 at a rate of 8 characters per raster. The output from this gate 3 is used to select one of sub-memories LB0 and LB1 of the buffer memory 4 as described below.

Figure 2:
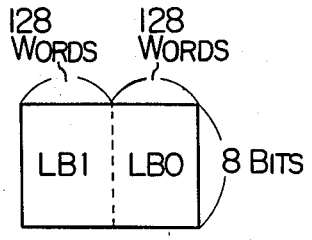
FIG. 2 is a schematic view to show that the buffer memory shown in FIG. 1 is split into an odd-row buffer memory and an even-row buffer memory.

As shown in detail in FIG. 2, the buffer memory 4 is composed of an odd-row buffer LB1 and an even-row buffer LB0 each of which can store one row portion of display data among those stored in the refresh memory 1. In the present embodiment, the buffer memory 4 is in the form of a random access memory having a capacity of 256 words×8 bits. Thus, each of the buffers LB0 and LB1 has a capacity of 128 words×8 bits so as to store one row portion of display data. However, according to the aforementioned premise, a capacity of 80 words×8 bits suffices since 80 characters are displayed in each of the rows. In the horizontal flyback period of one raster scan, display data is written from the register 35 into the buffer LB0 or LB1 at a rate of 8 characters. Therefore, one row portion of display data is completely written in the buffer LB0 or LB1 during the horizontal flyback periods of 10 raster scans.

In response to the application of the write address load signal 15 to the load terminal of the write address counter 8, a write start address m is loaded on the data input terminal of this counter 8. In the present embodiment, the write address counter 8 counts up from the address No. 0. This address counter 8 is used to indicate the addresses of display data written in the buffer LB0 or LB1 of the buffer memory 4, as shown by the signal LBWAC8 in FIG. 4. The address counter 8 counts to 80 corresponding to the number of characters in one row in response to the sequential application of the access delay signal 11 to its count-up terminal.

The output from the write address counter 8 is applied to the address switching unit 5. This address switching unit 5 is also in the form of a known multiplexer and effects a switching operation in response to the application of the buffer transfer signal 12 so as to transfer the counter output from the write address counter 8 or the read address counter 9 to the buffer memory 4. More precisely, as shown by the output signal MPX5 in FIG. 4, the output from the read address counter 9 is applied via the address switching unit 5 to the buffer memory 4 during the display period (CH#0 to CH#79) so as to read out display data corresponding to 80 characters (one row) from the buffer LB0 or LB1 selected by the output from the exclusive-OR gate 3. During the portion of the horizontal flyback period (CH#80 to CH#95), the output from the write address counter 8 is applied via the address switching unit 5 to the buffer memory 4 so as to write display data at a rate of 8 characters per raster scan from the register 35 in the buffer LB1 or LB0 from which no display data is being read out.

The display data read out from the buffer memory 4 is temporarily stored in the register 34, and the 80 characters (CH#0 to CH#79) are then read out one after another from the register 34 as shown by LBRDB34 in FIG. 4 to be transmitted to a known character generator (not shown). As is well known in the art, the character generator stores many character patterns, graphic patterns and ruling patterns, and the patterns corresponding to the character data and other data transmitted from the register 34 is read out and entrained on the scanning beam to be displayed on the CRT display screen.

The operation of the embodiment of the present invention will now be described in detail with reference to FIG. 3 in addition to FIGS. 1 and 4.

In the present embodiment, it is assumed that 80 characters are displayed in each of 24 rows on the display screen and each row is provided by 16 rasters. In each row, a character is depicted by 7 horizontal dots×9 vertical dots and is displayed by the rasters RST#1 to RST#9 among the 16 rasters.

Display data to be displayed on the display screen is applied from a preceding unit such as a terminal control equipment (TCE) (not shown) to the refresh memory 1 via the data bus 38 to be stored in the refresh memory 1 according to the display sequence.

Regardless of whether scanning involves an odd row or an even row, the address switching unit 2 selects the address bus 7 and the address switching unit 5 selects the read address counter 9 at the scanning starting time.

Suppose now that the 1st odd row is to be scanned with the 1st raster. At this time, the count of the row counter 33 is "0". The buffer transfer signal 12 (LBTRSF12) remains in its "0" level during the display period (CH#0 to CH#79). During this period, the output from the exclusive-OR gate 3 is "0", and the odd-row buffer LB1 of the buffer memory 4 is selected. The content of the read address counter 9 is applied via the address switching unit 5 to the odd-row buffer LB1, and display data corresponding to 80 characters is sequentially read out from the odd-row buffer LB1 and is temporarily stored in the register 34 before it is transmitted to the character generator. Subsequently, the buffer transfer signal 12 turns into its "1" level during the time (CH#80 to CH#95) of the horizontal flyback period. At this time, the output from the exclusive-OR gate 3 is "1", and the even-row buffer LB0 is selected. The refresh memory access signal 10 (RSACS10) takes its "1" level eight times during this time (CH#80 to CH#95) of the horizontal flyback period, since 8 characters are to be transferred from the refresh memory 1 to the buffer memory 4 during this time. The refresh memory address counter 6 counts up 8 addresses due to the application of the 8 pulses of the refresh memory access signal 10 to its count-up terminal, and the output from the address counter 6 appears at the output of the address switching unit 2, so that 8 characters (CH#0 to CH#7) to be displayed in an even row (the 2nd row) are read out from the refresh memory 1 and applied to the register 35. For the purpose of this reading operation, the phase of data setting in the register 35 is delayed by a time corresponding to one character relative to the refresh memory access signal 10 as shown by RFRDB35 in FIG. 4. In order that the characters registered in the register 35 can be written in the even-row buffer LB0 of the buffer memory 4, the access delay signal 11 (RFACSD11) delayed by a time corresponding to one character relative to the refresh memory access signal 10 is applied to the count-up terminal of the write address counter 8.

On the other hand, during the time (CH#80 to CH#95) of the horizontal flyback period, the buffer transfer signal 12 turns into "1" level, and the output from the exclusive-OR gate 3 turns into its "1" level so as to select the even-row buffer LB0 of the buffer memory 4. The address switching unit 5 is now switched over to apply the content of the write address counter 8 to the even-row buffer LB0 of the buffer memory 4. The content (LBWAC8 in FIG. 4) of the read address counter 8 which has sequentially counted up 8 pulses of the access delay signal 11 is used as address information so that the display data corresponding to the 8 characters registered in the register 35 can be written in the even-row buffer LB0 of the buffer memory 4.

No data is written in or read out from the buffer memory 4 after CH#96 in the horizontal flyback period. Needless to say, the content of the write address counter 8 is the same as the address information of the 8 characters stored in the even-row buffer LB0 of the buffer memory 4.

In this manner, the horizontal flyback period of the 1st raster scan terminates to be followed by the 2nd raster scan. In this case too, the 1st odd row is to be scanned as described above. Therefore, the count of the row counter 33 is still "0", and during the display period (CH#0 to CH#79), the output from the exclusive-OR gate 3 selects the odd-row buffer LB1, and the content of the read address counter 9 is applied via the address switching unit 5 to the odd-row buffer LB1. Display data corresponding to 80 characters (data similar to that above described) is read out from the odd-row buffer LB1 and is temporarily stored in the register 34 before it is applied to the character generator.

The operation in the horizontal flyback period is similar to that above described. In this horizontal flyback period, however, the refresh memory address counter 6 counts up 8 pulses corresponding to 8 characters (CH#8 to CH#15), and the 8 characters (CH#8 to CH#15) in the next even row (the 2nd row) are read out from the refresh memory 1 to be stored in the register 35. Likewise, the even-row buffer LB0 is selected again, and the write address counter 8 counts up additional 8 pulses so that the 8 characters (CH#8 to CH#15) following the previously stored 8 characters (CH#0 to CH#7) can be stored in the even-row buffer LB0. Thus, the 16 characters (CH#0 to CH#15) are stored in the even-row buffer LB0. Such an operation is similarly carried out thereafter so that display data corresponding to 8 characters×10 (=80 characters) are stored in the even-row buffer LB0 after scanning with 10 rasters in the 1st odd row. Although each individual row is scanned with 16 rasters, transfer of data from the refresh memory 1 to the buffer memory 4 for the purpose of character display in the next row terminates in the horizontal flyback period of 10 rasters.

Upon completion of scanning with 16 rasters for the display of the 80 characters in the odd row (the 1st row) in the manner above described, raster scanning for the display of 80 characters in the even row (the 2nd row) takes place. In the 1st raster scan in the even or 2nd row, the row count signal 14 is generated from the signal generator circuit 17, and the count of the row counter 33 increases from "0" to "1". During the display period (CH#0 to CH#79) with the 1st raster scan, the buffer transfer signal 12 remains in its "0" level, and the output from the exclusive-OR gate 3 is "1", with the result that the even-row buffer LB0 is selected. As described hereinbefore, the display data corresponding to 80 characters have already been stored in the even-row buffer LB0 as a result of the aforementioned raster scan for the 1st or odd row. During the display period, the content of the read address counter 9 is sequentially applied through the address switching unit 5 to the buffer memory 4, and the display data corresponding to 80 characters is sequentially read out at a rate of 8 characters from the even-row buffer LB0 and is temporarily stored in the register 34 before it is transferred to the character generator.

When the display period terminates and the horizontal flyback period begins, display data corresponding to 8 characters is read out from the refresh memory 1 during the time (CH#80 to CH#95) of the horizontal flyback period in a manner as described hereinbefore, and such data is now stored in the odd-row buffer LB1. In this manner, display data corresponding to 80 characters is stored in the odd-row buffer LB1 with after scanning with 10 rasters for the 2nd or even row.

Such a sequence is repeated so that display data to be displayed in the 1st row to 24th row on the display screen is alternately stored in the odd-row buffer LB1 and even-row buffer LB0, and from these buffers, the data is alternately read out and applied to the character generator which generates character patterns to display characters on the CRT display screen.

In the embodiment of the present invention, the raster scan for the 26th row which is the last even row in the vertical flyback period is utilized so that data to be displayed in the 1st row on the display screen can be read out from the refresh memory 1 to be stored in the odd-row buffer LB1 of the buffer memory 4. This is done for facilitating the control. Needless to say, no data or characters are displayed on the CRT display screen during this period, and the manner of storing display data corresponding to 80 characters in the odd-row buffer LB1 utilizing the horizontal flyback period is similar to that described hereinbefore.

It will be understood from the foregoing detailed description of the present invention that display data is transferred from the refresh memory 1 to the buffer memory 4 each time the refresh memory access signal 10 takes its "1" level in the horizontal flyback period of each raster scan. Therefore, the time zone in which this access signal 10 is not in its "1" level can be utilized to attain other sort of access to the refresh memory 1, for example, writing or reading of display data from an input/output unit or a preceding processor unit via the address bus 7 or data bus 38. Consequently, the possibility of obstruction against such access to the refresh memory 1 is greatly reduced to permit high-speed block data transfer and to greatly improve the performance of the CRT display.

In accordance with the present invention, a portion of the horizontal flyback period is utilized for reading out display data from the refresh memory 1 unlike the prior art in which the period of an inter-row space between the displayed character rows is utilized for the reading of display data. Therefore, when special display data such as graphic pattern data and ruling pattern data in addition to character pattern data is stored in the refresh memory 1 on the premise that all of the 16 rasters in each individual row are used to display such data, this data can be read out from the refresh memory 1 and transferred to the buffer memory 4 utilizing the horizontal flyback period so that the graphic patterns and ruling patterns can also be displayed. Further, due to the fact that display data corresponding to odd and even rows is alternately read out from the buffers LB0 and LB1 of the buffer memory 4, the refresh memory 1 need not be composed of high-speed memory elements, and the cost of the CRT display itself can also be reduced.

The present invention is in no way limited to the specific embodiment described hereinbefore, and various other changes and modifications may be made therein without departing from the scope of appended claims. Especially, various numerical expressions employed in the embodiment are merely illustrative and in no way limitative. For example, although display data corresponding to 8 characters per raster scan is read out from the refresh memory 1 and transferred to the buffer memory 4, display data corresponding to more characters per raster scan may be read out from the refresh memory 1 to be transferred to the buffer memory 4. Suppose, for example, that display data corresponding to 16 characters per raster scan is read out from the refresh memory 1 in the embodiment in which 112 character clocks are applied per raster scan. Then, display data corresponding to 80 characters can be read out from the refresh memory 1 by scanning with 5 rasters. On the contrary, the number of display data characters read out from the refresh memory 1 during each raster scan may be decreased so as to transfer or store the required display data by scanning with an increased number of rasters.

When access to the refresh memory 1 cannot be attained within one character clock cycle, the period of time required for reading out a character may, for example, be doubled so as to read out a character within two character clock cycles.

In the aforementioned embodiment of the present invention, display data for the 1st row is read out from the refresh memory 1 and transferred to the buffer memory 4 utilizing the horizontal flyback periods of the last even row or 26th row in the vertical flyback period so as to facilitate the control. However, this is not in any way a requisite, and when data is generally displayed over n rows on the display screen, display data for the 1st row may be read out from the refresh memory 1 and transferred to the buffer memory 4 utilizing the horizontal flyback periods of the nth row. It is apparent that a row counter capable of counting n is required in such a case.

The buffer memory 4 is required to have a capacity of storing at least two row portions of display data among those displayed on the display screen. Thus, the buffer memory 4 may have a capacity of storing, for example, three, four or more row portions of display data.

In the practice of the present invention, the registers 35 and 34 in the embodiment shown in FIG. 1 may be unnecessary sometimes. Although the register 35 is provided for storing data read out from the refresh memory 1 and for writing such data in the buffer memory 4, this register 35 is unnecessary when the refresh memory 1 and buffer memory 4 are accessible at a high speed. The register 34 is provided for registering data read out from the buffer memory 4 and for functioning as an address register for the character generator. However, this register 34 is also unnecessary when the buffer memory 4 or the character generator is accessible at a high speed. The buffer memory 4 may be in the form of a register. Further, the refresh memory 1 may not be an independent memory but may be a portion of a memory.

I claim:

1. A memory control unit in a display apparatus comprising:

(a) first memory means for storing coded data to be displayed over a plurality of rows on a display screen;

(b) first address means for designating addresses for reading out said coded data from said first memory means during a horizontal flyback period of the raster scan;

(c) second memory means having a memory capacity corresponding to at least two coded data rows on said display screen for storing coded data read out of said first memory means in groups corresponding to a display screen row; and (d) second address means for providing said second memory means with read addresses to read out the coded data stored in the second memory during a data display period and for providing said second memory means with write addresses to write therein display data from said first memory means of the next row of data during horizontal flyback periods of the raster scan of a coded data row.

2. A memory control unit in a display apparatus comprising:

(a) first memory means for storing character codes to be displayed over a plurality of rows on a display screen while scanning a raster;

(b) first address means for designating addresses for reading out character codes stored in said first memory means during a horizontal flyback period of a raster scan;

(c) second memory means having at least first and second memory areas, said second memory means storing said character codes read out of said first memory means in groups corresponding to a display row in said respective first and second memory areas;

(d) second address means for designating the addresses of the character codes to be written in said second memory means;

(e) third address means for designating the addresses of the character codes for reading out the character codes stored in said second memory means;

(f) address switching means carrying out an address switching function for applying the address from said third address designating means to said first or second memory area in said second memory means during the period of displaying a row with the raster scan on the display screen, while applying the address from said second address designating means to said first or second memory area in said second memory means during a predetermined time within the horizontal flyback period; and (g) memory area switching means for providing read and write addresses to said first and second memory areas alternately with successive display of character rows on said display screen so that said addresses from said second and said third address means are applied respectively to said first and second memory areas.

3. A memory control unit in a display apparatus as claimed in claim 2, wherein said second memory means includes first buffer means for storing character codes displayed in an odd row on the display screen and second buffer means for storing character codes displayed in an even row on the display screen.

4. A memory control unit in a display apparatus as claimed in claim 2, further comprising second address switching means carrying out an address switching function for applying, during the predetermined time only of the horizontal flyback period of the raster scan of a character row on the display screen, the address from said first address designating means to said first memory means for reading out character codes to be displayed on a row next to be displayed.

5. A memory control unit in a display apparatus as claimed in claim 2, further comprising register means for temporarily storing character codes read out of said first memory means to be stored in said second memory means.

6. A display control unit in a display apparatus as claimed in claim 2, further comprising register means for temporarily storing character codes read out of said second memory means to be transmitted to a character generator.

7. A display control unit in a display apparatus as claimed in claim 2, further comprising register means for temporarily storing character codes read out of said first memory means to be transmitted to means other than said second memory means.

8. A memory control unit in a display apparatus for displaying character patterns with raster scanning over a plurality of rows on a display screen comprising:

(a) first memory means for storing coded data designating a plurality of character patterns;

(b) first address counter means for designating addresses to said first memory means for reading therefrom coded data corresponding to character patterns to be displayed in the row next to that of data currently being displayed on said display screen;

(c) an address bus for transmitting addresses of data for writing and reading out data into and from said first memory means;

(d) a data bus for transmitting data to be written in at least said first memory means;

(e) first address switching means for applying the address from said first address counter means to said first memory means during a first predetermined time within the horizontal flyback period of the raster scan on the display screen, and, on the other hand, applying the addresses from said address bus to said first memory means during a second predetermined time other than said first predetermined time;

(f) row counter means for sequentially counting the number of character rows on the display screen;

(g) second memory means including a first memory area and a second memory area for storing data read out of said first memory means to be displayed in each of the adjacent rows on the display screen;

(h) second address counter means for selectively designating the addresses of said first memory area or said second memory area for writing the data read out of said first memory means to be written in said buffer memory;

(i) third address counter means for selectively designating the addresses in said first memory area or said second memory area for reading out the data stored in said second memory means;

(j) second address switching means for applying the address from said third address counter means to said first or second memory area during the display period of a character row with the raster scan on the display screen and, on the other hand, applying the address from said second address counter means to said first or second memory area during a time within horizontal flyback periods of the raster scan; and (k) memory area switching means for applying addresses alternately to the first and second memory areas accessed by said second and third address counter means in accordance with the output of said row counter means.

9. A memory control unit in a display apparatus as claimed in claim 8, further comprising register means for temporarily storing the data read out of said first memory means to be transmitted to said data bus.

10. A memory control unit in a display apparatus as claimed in claim 8, further comprising register means for temporarily storing the data read out of said first memory means to be transmitted to said character generator.

11. A memory control unit in a display apparatus as claimed in claim 8, wherein said memory area specifying means includes an exclusive-OR gate whose input signals are the output signal from said row counter means and a signal indicative of the continuous predetermined time within the horizontal flyback period during which the data read out from said first memory means is stored in said first or second memory area of said second memory means.

12. A character data processing unit for displaying character patterns by raster scanning a plurality of character rows on a screen of a cathode-ray tube, comprising:

(a) refresh memory means for storing character data to be displayed as a plurality of character patterns;

(b) first address counter means for sequentially applying addresses to said refresh memory means so that, during scanning of a character row on the CRT screen, data to be displayed in a row next to said row can be read out of said refresh memory means;

(c) an address bus for transmitting addresses for writing and reading out data in and from said refresh memory means;

(d) a data bus for transmitting data written in and read out of said refresh memory means;

(e) first address selecting means for selecting the address from said first address counter means during a predetermined time within the horizontal flyback period of the raster scan and, on the other hand, selecting the address from said address bus during a time other than said predetermined time, thereby permitting access to said refresh memory means according to the address so selected;

(f) row counter means for sequentially counting the number of character rows on the CRT screen;

(g) buffer memory means including a first row buffer and a second row buffer for sequentially storing the data in each of adjacent character rows read out of said refresh memory means;

(h) second address counter means designating the addresses of said row buffer or said second row buffer for writing the data read out of said refresh memory means in said buffer memory means;

(i) third address counter means designating the addresses of said second row buffer or said first row buffer for reading out the data written in said buffer memory means;

(j) second address selecting means for selecting the address from said third address counter during the display period of the raster scan of a character row on the CRT screen, and, on the other hand, selecting the address from said second address counter during the predetermined time within the horizontal flyback period, thereby permitting access to said buffer memory means according to the address so selected; and (k) row buffer switching means for selecting said first and second row buffers, thereby exchanging a row buffer to be accessed by said second address counter means for a row buffer to be accessed by said third address counter means, at each incrementing of said row counter means.

13. A character data processing unit in a CRT display as claimed in claim 12, further comprising register means for temporarily storing the data read out of said first or second row buffer of said buffer memory means to be transmitted to said character generator.

14. A character data processing unit in a CRT display as claimed in claim 12, further comprising register means for temporarily storing the data read out of said refresh memory means to be transmitted to said data bus.

* * * * *